US007690940B1

(12) United States Patent
Burr

(10) Patent No.: US 7,690,940 B1
(45) Date of Patent: Apr. 6, 2010

(54) POWER CORD COUPLING DEVICE

(76) Inventor: Timothy Burr, 8 Chester St., Oneonta, NY (US) 13820

( * ) Notice: Subject to any disclaimer, the term of this patent is extended or adjusted under 35 U.S.C. 154(b) by 0 days.

(21) Appl. No.: 12/241,487

(22) Filed: Sep. 30, 2008

(51) Int. Cl.
*H01R 13/62* (2006.01)

(52) U.S. Cl. ..... 439/367

(58) Field of Classification Search ..... 439/367, 439/369, 368

See application file for complete search history.

(56) References Cited

U.S. PATENT DOCUMENTS

| | | | | |
|---|---|---|---|---|
| 2,464,893 | A | 3/1949 | Ross | |
| 2,913,791 | A | 11/1959 | Martin | |
| 3,014,194 | A | 12/1961 | Berglund | |
| 3,048,810 | A | 8/1962 | Steen | |
| 3,223,958 | A | 12/1965 | Prohl | |
| 3,281,755 | A * | 10/1966 | Trager | 439/320 |
| 3,344,393 | A | 9/1967 | Hendee | |
| 3,383,639 | A | 5/1968 | Anderson | |
| 3,475,716 | A | 10/1969 | Laig | |
| 3,609,638 | A | 9/1971 | Darrey | |
| 4,940,424 | A | 7/1990 | Odbert | |
| 5,505,634 | A | 4/1996 | Osten | |
| 5,582,524 | A | 12/1996 | Sanner | |
| 5,772,462 | A | 6/1998 | Osten | |
| 6,602,087 | B1 | 8/2003 | Carle | |
| 7,442,067 | B1 * | 10/2008 | Amaral | 439/369 |
| 7,537,477 | B2 * | 5/2009 | Crossman et al. | 439/373 |

* cited by examiner

*Primary Examiner*—Phuong K Dinh
(74) *Attorney, Agent, or Firm*—Michael A. Blake

(57) ABSTRACT

A power cord coupling device comprising: a compressible base with a first end and a second end, and the second end is threaded; a threaded cap, configured to thread onto the second end of the compressible base; and where compressible base is configured to compress about a coupled plug and receptacle located within the compressible base upon a tightening of the threaded cap onto the second end of the compressible base. A power cord coupling device comprising: an inner compressible member of a first length, the inner compressible member comprising: a plug-receptacle volume located within the inner compressible member; an inner slot extending along the first length; a first end with a first end slot that is contiguous with the inner slot; a second end, the second end being generally opened; an inner set of teeth located on an outer surface of the inner compressible member; an outer member of a second length, removeably attachable to the inner compressible member; the outer member comprising: an outer slot extending along the second length; a first end, the first end being generally opened; a second end with a second end slot that is contiguous with the inner slot; an outer set of teeth located on an inner surface of the outer member, the outer set of teeth configured to mesh with the inner set of teeth to hold the inner compressible member within the outer member. To be completed upon approval of claim scope.

2 Claims, 4 Drawing Sheets

POWER CORD COUPLING DEVICE

TECHNICAL FIELD

This invention relates to improved connection between electrical cords. More particularly, it relates to an accessory for holding two electrical cords in connection and preventing their accidental disconnection.

BACKGROUND

There is a need for a simple, inexpensive, practical device to maintain the separable elements of an extension cord coupling against inadvertent separation. Frequently, the electrical cords of typical electrical equipment such as vacuum cleaners, hedge trimmers, or industrial machinery such as hand drills, extension lights and the like, must be coupled to an extension cord to reach their desired location of use. The inherent strength of the coupling brought about by the friction between the prongs of one plug on the first cord and their corresponding receptacle on the second cord generally will not withstand a force beyond the most moderate separating tension. In fact, this "unplugability" is a property built into common household cords.

One solution to this has been the use of "twist-lock" connectors. These find acceptance in heavy-duty industrial and theatrical settings. "Twist-lock" connectors employ special prongs and receptors which are not compatible with normal home or light industrial wall plugs or with the connectors on normal extension cords. Accordingly, this solution, while effective in an industrial setting, does not work in many more common applications.

Other devices have been developed for common applications of a power cord coupler. However, some of these devices place an undue amount of strain on the connection between the plugs, and, therefore, may damage the plugs or the electrical cords. Other devices which employ a clamp or similar apparatus may damage the electrical integrity of the conductors, the insulation, or the cover of the extension cord. Still other devices may waste a considerable amount of cord length due to the necessity of winding the cord around the device to transfer the strain from the cord to the device.

Thus, there is a need for a power cord coupling device that overcomes these and other disadvantages.

SUMMARY

The disclosed invention relates to a power cord coupling device comprising: a compressible base with a first end and a second end, and the second end is threaded; a threaded cap, configured to thread onto the second end of the compressible base; and where compressible base is configured to compress about a coupled plug and receptacle located within the compressible base upon a tightening of the threaded cap onto the second end of the compressible base.

The disclosed invention also relates to a power cord coupling device comprising: an inner compressible member of a first length, the inner compressible member comprising: a plug-receptacle volume located within the inner compressible member; an inner slot extending along the first length; a first end with a first end slot that is contiguous with the inner slot; a second end, the second end being generally opened; an inner set of teeth located on an outer surface of the inner compressible member; an outer member of a second length, removeably attachable to the inner compressible member; the outer member comprising: an outer slot extending along the second length; a first end, the first end being generally opened; a second end with a second end slot that is contiguous with the inner slot; an outer set of teeth located on an inner surface of the outer member, the outer set of teeth configured to mesh with the inner set of teeth to hold the inner compressible member within the outer member. to be completed upon approval of claim scope

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
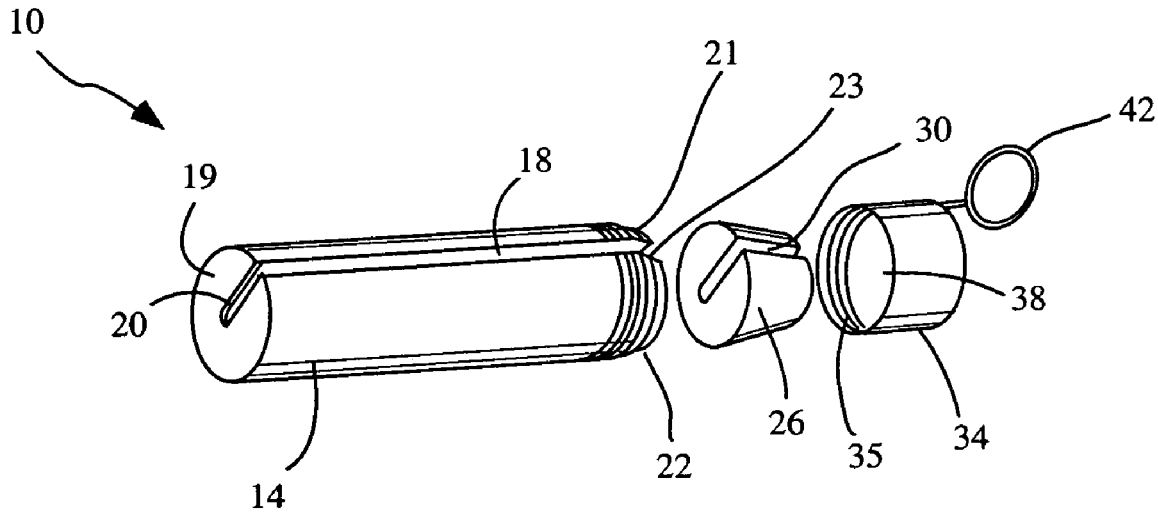
FIG. 1 is a perspective view of the disclosed power cord coupling device.

FIG. 1 shows a perspective exploded view of the disclosed power cord coupling device 10. The device comprises a base 14. The base has a slot 18 that extends its entire length. The base has a first end 19 with a slotted opening 20. The slot of the slotted opening 20 is contiguous with the slot 18. On a second end 21 of the base 14 are tapered pipe threads 22. Configured to fit within the second end 21 of the base 14 is a compressible plug 26. The second end 21 has an opening 23 able to fit around the compressible plug 26. The plug 26 has a plug slot 30 that extends its entire length. Configured to attach to the tapered pipe threads 22 is a cap 34. The cap 34 has tapered pipe threads 35 on its interior surface, to allow it to thread onto the tapered pipe threads 22. The cap 34 also has a connector 42 attached to it. The connector 42 may be a ring to allow one to hang the power cord coupling device 10 to a ladder, hangar, or any other object. Although a ring is shown as the connector 42, other connecting devices may be used, such as, but not limited to: a strap, a loop, a hangar, a hook, or a length of material with Velcro on one end. The cap 34 also has an opening 38 that is configured to allow a cord and plug or cord and receptacle to fit through the opening 38.

Figure 2:
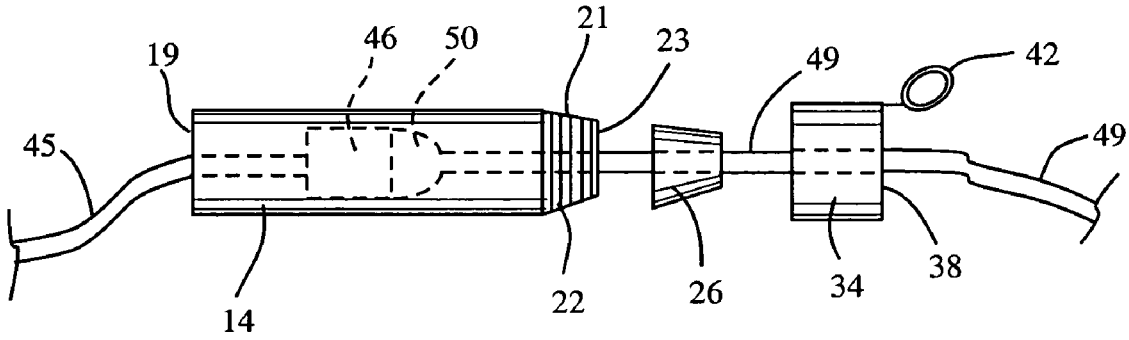
FIG. 2 is a front view of the disclosed power cord coupling device from FIG. 1.

FIG. 2 shows a top view of the disclosed power cord coupling device 10 from FIG. 1. In this view, the power cord coupling device 10 is shown with a first power cord 45 with a plug 46 coupled to a second power cord 49 with a receptacle 50. Although two power cords 45, 49 are shown in FIG. 2, it should be obvious to one of ordinary skill in the art, that the device may couple a power cord to an extension cord, an extension cord to an extension cord, a power strip cord to an extension cord, industrial power cords may also be coupled to each other, and any other two cords that need to be more securely coupled. The plug 46 of the first cord 45 is located inside the base 14 via the slotted opening 20 and slot 18 (from FIG. 1). The second cord 49 and receptacle 50 is fed through the cap 34 via the opening 38, and into the base via the opening 23, such that the receptacle 50 is coupled to the plug 46. The compressible plug 26 fits over the cord 49 via the plug slot 30. The compressible plug 26 may already be within the base 14 in the second end 21 before the cord is placed within the plug slot 30. Alternatively, the plug, with the cord 49 already in the plug slot 30, may subsequently be placed inside the base 14 in the second end 21.

The base 14 may be made from Polyvinyl Chloride, high density polyethylene, rubber, polypropylene, plastic, nylon, memory alloy, or any material that will slightly compress as the cap 34 is screwed onto the tapered pipe threads 22. Thus, when the cap 34 is screwed onto the tapered pipe threads 22, the base 14 will compress. As the cap 34 is screwed on tighter onto the threads 22, the base will compress more. Therefore, as the base 14 compresses, it will compress about plug 26, thereby providing a compressive and frictional hold on the cord 49. Additionally, as the base 14 compresses, it will compress about the plug 46 and receptacle 50, thereby providing a compressive holding force on the plug 46 and receptacle 50, in addition to a greater frictional holding forcing on the plug 46 and receptacle 50. The compressible plug 26 may be made from Polyvinyl Chloride, high density polyethylene, rubber, polypropylene, plastic, nylon, memory alloy, or any material that will compress under sufficient pressure. The base 14 may be alternatively sized to fit industrial sized plugs and receptacles, home use sized plugs and receptacles, in addition to very large and very small sized plugs and receptacles.

Figure 3:
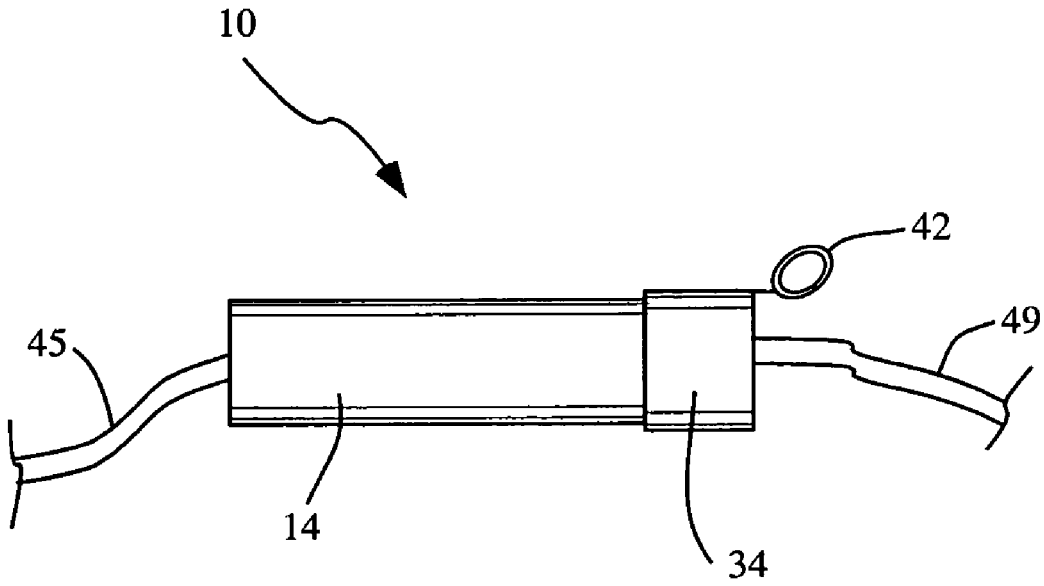
FIG. 3 is a front view of the disclosed power cord coupling device in an "in use" configuration.

FIG. 3 shows a front view of the device 10, in it's at use state. The cap 34 is screwed onto the base 14. The base 14 has compressed onto the plug 46 (not visible in this view) and receptacle 50 (not visible in this view). The base 14 has also compressed upon the compressible plug 26 (not visible in this view), located within the second end 21 (not visible in this view) of the base 14.

Figure 4:
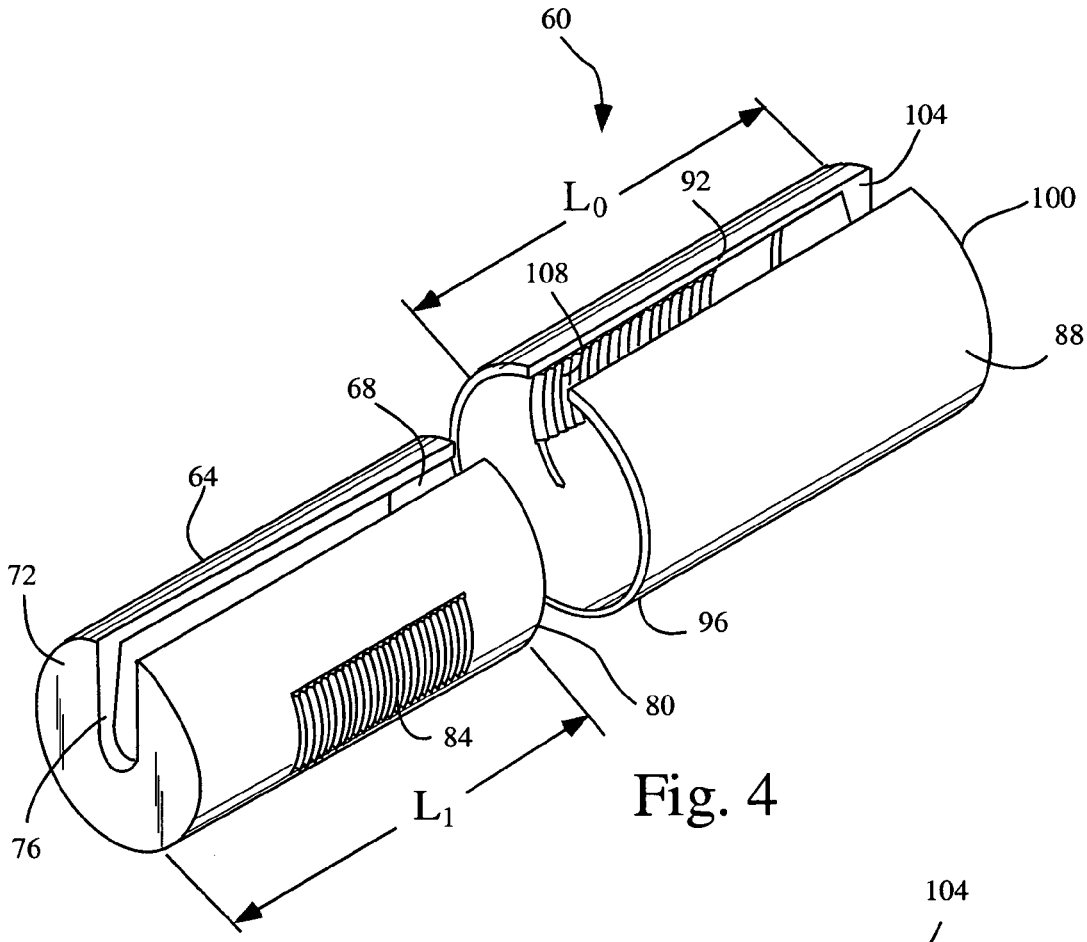
FIG. 4 is a perspective view of another embodiment of the disclosed power cord coupling device.
Figure 5:
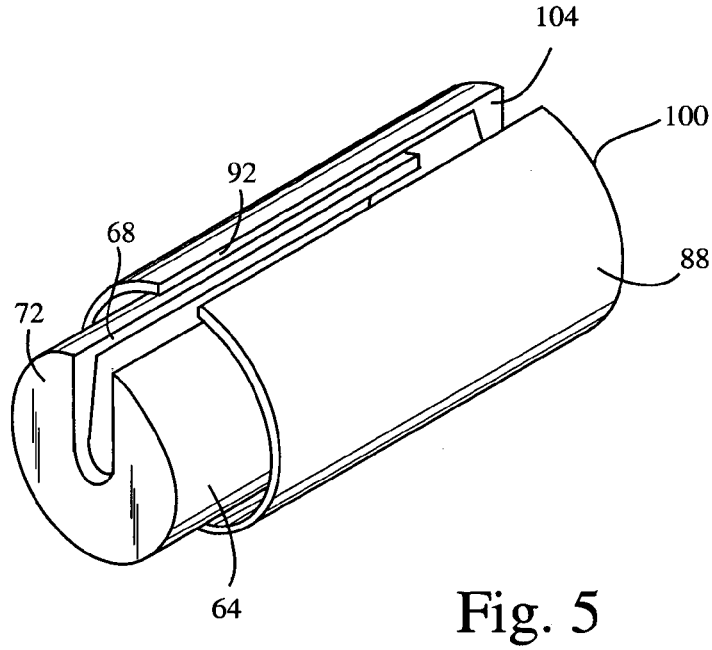
FIG. 5 is a perspective view of the disclosed power cord coupling device from FIG. 4, with the inner compressible member located within the outer member.

FIG. 4 shows another embodiment of the disclosed power cord coupling device 60. This embodiment comprises an inner compressible member 64 with a generally cylindrical shape. The inner compressible member 64 has an inner slot 68 that runs generally along the entire length $L_I$ of the inner compressible member. The interior of the inner compressible member 64 contains a plug-receptacle volume that is configured to be able to snugly hold a plug 46 coupled to a receptacle 50. A first end 72 of the inner compressible member 64 is generally closed except for a first end slot 76 that is contiguous with the inner slot 68. The second end 80 of the inner compressible member 64 is generally opened. The inner compressible member 64 has at least one set of inner teeth 84 located on its outer surface. This embodiment also comprises an outer member 88 with a generally cylindrical shape. The outer member 88 has an outer slot 92 that runs generally along the entire length $L_O$ of the outer member. The interior of the outer member 88 has an opening that is configured to be able to hold the inner compressible member 64. In other embodiments, the outer member 88 may have an interference fit with the inner compressible member 88. A first end 96 is generally opened. A second end 100 of the outer member 88 is generally closed except for a second end slot 104 that is contiguous with the outer slot 92. The outer member 88 has at least one set of outer teeth 108 located on it's the inner surface. In one embodiment the outer teeth 108 and inner teeth 84 are configured to mesh when the inner slot 68 and outer slot 92 are aligned, as shown in FIG. 5. In another embodiment, the outer teeth 108 and inner teeth 84 are configured to mesh when the inner slot 68 and outer slot 92 are offset by a quarter turn relative to when the slots 68, 92 are originally aligned. In still another embodiment, the outer teeth 108 and inner teeth 84 are configured to mesh when the inner slot 68 and outer slot 92 are offset by a half turn relative to when the slots 68, 92 are originally aligned. The inner compressible member 64 may be made from Polyvinyl Chloride, high density polyethylene, rubber, polypropylene, plastic, nylon, memory alloy, or any material that will slightly compress when placed in the outer member 88 with an interference fit.

FIG. 5 shows the inner compressible member 64 placed within the outer member 88.

One means of using the power cord coupling device disclosed in FIGS. 4 and 5 is as follows. Start with the inner compressible member 64 separated from the outer member 88. Plug a plug 46 of a first power cord into a receptacle 50 of second power cord. Slide the first power cord into the inner slot 68 such that the plug 46 and receptacle 50 are located in the plug-receptacle volume of the inner compressible member 64 (the plug 46 and receptacle 50 will easily enter the inner compressible member 88 through the opening in the second end 80) and with the first power cord exiting the inner compressible member 64 through the first end slot 76. Now the inner compressible member 64 can be slid into the outer member 88 through the opening located at the first end 96 of the outer member 88, making sure that the second power cord is exiting the inner compressible member 64 through the inner slot 68 and exiting the outer member 88 through the outer slot 92 or through the second end slot 104. The inner compressible member 64 can only slide as far as the second end of the outer member 88 due to the generally closed second end 100. In one embodiment, with the inner and outer slots 68, 92 aligned, the inner and outer teeth 84, 108 will engage, and keep the inner compressible member 64 from separating from the outer member 88. In another embodiment, the teeth will engage when either the outer member 88 or inner member 64 is turned ¼ turn with respect to the other member. In still another embodiment, the teeth will engage when either the outer member 88 or inner member 64 is turned ½ turn with respect to the other member. When one is done using the power cord coupling device, one merely needs to disengage the inner teeth 84 from the outer teeth 108 by giving a partial turn to either the inner compressible member 64 or the outer member 88 with respect to the other member.

The disclosed power cord coupling device 10 is easy to use, inexpensive to manufacture, and allows for quick coupling of cords once the cords are placed in the base 14 with the plug 26. The disclosed power cord coupling device 10 also allows for the quick de-coupling of cords by simply screwing or unscrewing the cap 34, and then de-coupling the cords. The embodiments disclosed in FIGS. 4 and 5 are advantageous too, since the embodiment comprises only two parts, the manufacturing costs will be relatively inexpensive. Additionally, the power cord coupling device is easier to use, with fewer parts. In addition, all the disclosed embodiments will place very little strain on the plugs, receptacles and cords. The disclosed invention will not damage the electrical integrity of the power cords, due to the fact that plug and receptacle are held together by friction of the base 14 or inner member 64.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

The invention claimed is:

1. A power cord coupling device comprising:

an inner compressible member of a first length, the inner compressible member comprising:

a plug-receptacle volume located within the inner compressible member;

an inner slot extending along the first length;

a first end with a first end slot that is contiguous with the inner slot;

a second end, the second end being generally opened;

an inner set of teeth located on an outer surface of the inner compressible member;

an outer member of a second length, removeably attachable to the inner compressible member; the outer member comprising:

an outer slot extending along the second length;

a first end, the first end being generally opened;

a second end with a second end slot that is contiguous with the inner slot;

an outer set of teeth located on an inner surface of the outer member, the outer set of teeth configured to mesh with the inner set of teeth to hold the inner compressible member within the outer member.

2. The power cord coupling device of claim 1, wherein the inner compressible member is made from a material selected from the group consisting of polyvinyl chloride, high density polyethylene, rubber, polypropylene, plastic, nylon, and memory alloy.

* * * * *